US006344262B1

(12) United States Patent
Suzuki

(10) Patent No.: US 6,344,262 B1
(45) Date of Patent: Feb. 5, 2002

(54) INK JET RECORDING MEDIUM AND RECORDED PRODUCT

(75) Inventor: Shinichi Suzuki, Yokohama (JP)

(73) Assignee: Asahi Glass Company Ltd., Tokyo (JP)

( * ) Notice: Subject to any disclaimer, the term of this patent is extended or adjusted under 35 U.S.C. 154(b) by 0 days.

(21) Appl. No.: 09/457,740

(22) Filed: Dec. 10, 1999

(30) Foreign Application Priority Data

Dec. 14, 1998 (JP) ..... 10-354656

(51) Int. Cl.[7] ..... B41M 5/00
(52) U.S. Cl. ..... 428/195; 428/328; 428/329
(58) Field of Search ..... 428/195, 328, 428/329

(56) References Cited

U.S. PATENT DOCUMENTS

| | | | | |
|---|---|---|---|---|
| 5,264,275 A | | 11/1993 | Misuda et al. | |
| 5,463,178 A | | 10/1995 | Suzuki et al. | |
| 5,624,482 A | | 4/1997 | Kijimuta et al. | |
| 5,670,249 A | | 9/1997 | Tanuma | |
| 5,738,932 A | * | 4/1998 | Kondo et al. | 428/195 |

* cited by examiner

*Primary Examiner*—Pamela R. Schwartz
(74) *Attorney, Agent, or Firm*—Oblon, Spivak, McClelland, Maier & Neustadt, P.C.

(57) ABSTRACT

An ink jet recording medium which comprises a substrate and a porous layer containing an alumina hydrate formed on the substrate, wherein Mg ions and SCN ions are contained in said porous layer.

10 Claims, No Drawings

INK JET RECORDING MEDIUM AND RECORDED PRODUCT

BACKGROUND OF THE INVENTION

1. Field of the Invention

The present invention relates to an ink jet recording medium and a recorded product.

2. Discussion of Background

In recent years, reflecting wide use of computers and digital cameras, hard copy technology to record images thereof on e.g. paper sheets has been developed. As hard copy recording systems, e.g. an ink jet system, a melting type thermal transfer system, a sublimation type thermal transfer system and an electrostatic transfer system have been known. Among these, an ink jet system has been widely used in recent years, since full-colored recorded products having a high image quality can be obtained, and the printing noise is low. Along with demands for high speed recording and high accuracy, it has been required for a recording medium to have high level of characteristics.

As the ink jet recording medium, a recording medium comprising a substrate and an ink-receiving layer made of a porous layer containing an alumina hydrate formed on the surface of the substrate, has been known (JP-A-2-276670). This recording medium is excellent in ink absorptivity, in the property for fixing colorants in the ink, and also in transparency of the porous layer, whereby an image having a high color density and a good color reproduction property can be obtained. Further, it has excellent characteristics as a recording medium, such as a high image quality and a high glossiness. Further, since it has a high transparency, it is also applied to sheets for an overhead projector.

SUMMARY OF THE INVENTION

It is an object of the present invention to provide a recording medium with which a recorded product having a high durability, particularly a high light resistance and ozone resistance, can be obtained, while maintaining the above-mentioned characteristics of the recording medium comprising a substrate and a porous layer containing an alumina hydrate formed on the substrate.

The present invention provides an ink jet recording medium which comprises a substrate and a porous layer containing an alumina hydrate formed on the substrate, wherein Mg ions and SCN ions are contained in said porous layer.

In the present invention, Mg ions and SCN ions are contained in the porous layer containing an alumina hydrate, whereby light resistance and ozone resistance will improve. This effect is considered to be mainly due to effects by the SCN ions, and it is considered that the Mg ions also have effects to increase the light resistance and the ozone resistance. In a case where Ca ions instead of the Mg ions are contained in the porous layer containing an alumina hydrate, although the Ca ions will not particularly inhibit the effect of the SCN ions, the colorants in the ink tend to aggregate due to the Ca ions, whereby the ink absorptivity of the porous layer may decrease, such being undesirable.

The Mg ions and the SCN ions are preferably contained in a form of a salt so that they easily dissociate as ions when the ink is imparted to the porous layer. A mixture of a salt containing the Mg ions and a salt containing the SCN ions may be contained, or a salt containing the Mg ions and the SCN ions may be contained. The Mg ions and the SCN ions may be contained as a salt containing other ions. However, if a large amount of other ions co-exist, the printing property may be influenced, and accordingly, the Mg ions and the SCN ions are preferably contained as a salt containing the Mg ions and the SCN ions alone, particularly as $Mg(SCN)_2$.

DETAILED DESCRIPTION OF THE PREFERRED EMBODIMENTS

In the present invention, the substrate is not particularly limited, and various ones may be used. Specifically, plastics including polyester resins such as polyethylene terephthalate and polyester diacetate, polycarbonate resins, fluororesins such as ETFE, and polyvinyl chloride resins, paper sheets and synthetic paper sheets may, for example, be preferably used. Further, cloths, glass and metals are also used. Such a substrate may be subjected to a corona discharge treatment or undercoating, in order to e.g. improve the bonding strength of the porous layer. Particularly when an opaque plastic film containing a white pigment or a paper sheet is used as the substrate, a recorded product equal to a silver halide photography can be obtainable.

In the present invention, the porous layer containing an alumina hydrate functions to absorb inks and to fix colorants. As the alumina hydrate, boehmite is preferred in view of transparency, color reproduction property, ink absorptivity and property for fixing colorants. Here, boehmite is an alumina hydrate represented by the compositional formula $Al_2O_3.nH_2O$ (n is from 1 to 1.5).

In the present invention, the porous layer containing the alumina hydrate preferably has an average pore radius of from 5 to 20 nm, and a volume of pores having pore radii of from 1 to 100 nm of from 0.3 to 2.0 cc/g. If the average pore radius or the volume of pores of the porous layer is beyond the above-specified range, no adequate ink absorptivity tends to be obtainable. Here, the pore characteristics are measured by a nitrogen adsorption/desorption method.

When the Mg ions and the SCN ions are contained in an equivalent amount, i.e. the SCN ions are contained in an amount of 2 moles per 1 mole of the Mg ions, the content is preferably such that $Mg(SCN)_2$ is from 1.5 to 45 wt % based on the alumina hydrate. If the content of $Mg(SCN)_2$ is less than 1.5 wt %, no adequate effect may be obtainable. On the other hand, if it exceeds 45 wt %, the ink absorptivity or resolution may decrease. The more preferred content of $Mg(SCN)_2$ is from 4.5 to 25 wt %.

As a method to have the Mg ions and the SCN ions contained in the porous layer containing the alumina hydrate, specifically, a method of forming the porous layer containing the alumina hydrate, and then imparting an aqueous solution containing the Mg ions and the SCN ions thereto, followed by drying, is preferred. As the method of imparting the solution, preferred is an impregnation method or a spray method. Further, a material containing the Mg ions and the SCN ions may preliminarily be added to a material for forming the porous layer containing the alumina hydrate.

The porous layer containing the alumina hydrate preferably contains a binder together with the alumina hydrate. As the binder, an organic high polymer such as starch or its modified product, a polyvinyl alcohol or its modified product, SBR latex, NBR latex, carboxymethyl cellulose, hydroxymethyl cellulose or polyvinyl pyrrolidone may be used. The amount of the binder is preferably from 5 to 50 wt % based on the alumina hydrate. If the amount of the binder is less than 5 wt %, the strength of the porous layer containing the alumina hydrate may be inadequate, and if it exceeds 50 wt %, the property for absorbing and fixing inks may be inadequate.

As the method for forming the porous layer containing the alumina hydrate on the substrate, preferred is a method of adding the binder and a solvent to the alumina hydrate to obtain a coating fluid, and coating the fluid on the substrate followed by drying. As the solvent for the coating fluid, an aqueous one is preferred. It is preferred to use an alumina sol as the material for the alumina hydrate, since a porous layer having an excellent transparency and glossiness can be formed. As the method for coating the coating fluid, a dye coater, a roll coater, an air knife coater, a blade coater, a rod coater, a bar coater, a comma coater or the like may be employed.

The thickness of the porous layer containing the alumina hydrate is optionally selected depending upon the mode of printers or absorptivity of the substrate. When the substrate has no absorptivity, the thickness of the porous layer is preferably from 5 to 100 $\mu$m. If the thickness of the porous layer is less than 5 $\mu$m the ink absorptivity and the property for fixing colorants may be inadequate, and if it exceeds 100 $\mu$m, the strength of the alumina hydrate layer may decrease. When the substrate has no absorptivity, more preferred thickness of the porous layer is from 10 to 50 $\mu$m.

Further, when the substrate has absorptivity, the thickness of the porous layer is preferably from 1 to 50 $\mu$m. If the thickness is less than 1 $\mu$m, the ink absorptivity and the property for fixing colorants may be inadequate, and if it exceeds 50 $\mu$m, the strength of the alumina hydrate layer may decrease. When the substrate has absorptivity, more preferred thickness of the porous layer is from 1 to 30 $\mu$m.

Now, the present invention will be described in further detail with reference to Examples. However, it should be understood that the present invention is by no means restricted to such specific Examples.

EXAMPLE 1

100 g of an alumina sol having a solid content of 18 wt % synthesized by hydrolysis of an aluminum alkoxide followed by peptization, and 32 g of a 6.2 wt % polyvinyl alcohol 6.2 wt % aqueous solution, were mixed to prepare a coating fluid. The coating fluid was coated on a paper substrate having a basis weight of 180 g/m$^2$ by a bar coater so that the coating amount after drying was 28 g/m$^2$, followed by drying, to form a porous layer containing an alumina hydrate. The alumina hydrate in the porous layer was boehmite.

The porous layer was infiltrated with a $Mg(SCN)_2$ aqueous solution followed by drying, so that $Mg(SCN)_2$ was contained in an amount of 18 wt % based on the alumina hydrate, to obtain a recording medium.

EXAMPLE 2

A porous layer containing an alumina hydrate was formed in the same manner as in Example 1, and the porous layer was infiltrated with a NaSCN aqueous solution and a $MgCl_2$ aqueous solution followed by drying, so that $Mg(SCN)_2$ was contained in an amount of 18 wt % based on the alumina hydrate, to obtain a recording medium.

EXAMPLE 3

A porous layer containing an alumina hydrate was formed in the same manner as in Example 1, and the porous layer was infiltrated with a $Ca(SCN)_2$ aqueous solution and a $MgCl_2$ aqueous solution followed by drying, so that $Mg(SCN)_2$ was contained in an amount of 20 wt % based on the alumina hydrate, to obtain a recording medium.

EXAMPLE 4

Comparative Example

A porous layer containing an alumina hydrate was formed in the same manner as in Example 1, and a recording medium was obtained without the infiltration treatment.

Printing Evaluation

With respect to each of the recording mediums of Examples 1 to 4, a pattern was printed by using an ink jet printer (PM750C, trade name, manufactured by Seiko Epson Co., Ltd.), whereupon printing properties were visually evaluated. With the recording mediums of Examples 1 and 4, clear images were obtained. With the recording medium of Example 2, although an almost satisfactory image was obtained, deposition of NaCl was observed at the printed portion. With the recording medium of Example 3, the colorants in the inks aggregated by the Ca ions, whereby the ink absorptivity was poor, and part of the image deteriorated.

Evaluation for Light Resistance

Each of the recording mediums having image recorded thereon in the above-mentioned printing evaluation, was irradiated with light by means of a xenon lamp type light resistance testing apparatus (manufactured by Suga Shikenkisya). Changes in hue after 40 hours were visually evaluated. The change in hue was significant in the recording medium of Example 4, whereas the change in hue was small in the recording mediums of Examples 1 to 3.

Ozone Resistance

Each of the recording mediums having images recorded thereon in the above-mentioned printing evaluation, was exposed to an ozone atmosphere by means of a testing apparatus for deterioration by ozone (manufactured by Suga Shikenkisya). Changes in hue after 40 hours were visually evaluated. The change in hue was significant in the recording medium of Example 4, whereas the change in hue was small in the recording mediums of Examples 1 to 3.

The ink jet recording medium of the present invention is particularly excellent in light resistance and ozone resistance of the ink, and is excellent in absorptivity and image clarity. It is particularly suitable for recording by using water-soluble inks.

What is claimed is:

1. An ink jet recording medium which comprises a substrate and a porous layer containing an alumina hydrate formed on the substrate, wherein Mg ions and SCN ions are contained in said porous layers, wherein said Mg ions and SCN ions are present in equivalent amounts to amounts provided by 1.5 to 45 wt % of $Mg(SCN)_2$, based on the alumina hydrate.

2. The ink jet recording medium according to claim 1, wherein the Mg ions and the SCN ions are contained as $Mg(SCN)_2$.

3. The ink jet recording medium according to claim 2, comprising 1.5 to 45 wt % of said $Mg(SCN)_2$, based on the alumina hydrate.

4. The ink jet recording medium according to claim 3, comprising 4.5 to 25 wt % of said $Mg(SCN)_2$, based on the alumina hydrate.

5. A recorded product having an image by colorants formed on the ink jet recording medium as defined in claim 1.

6. The ink jet recording medium according to claim 1, wherein said amount is from 4.5 to 25 wt %.

7. The ink jet recording medium according to claim 1, wherein said porous layer contains a binder.

8. The ink jet recording medium according to claim 7, wherein the binder is selected from the group consisting of starch, modified products thereof, polyvinyl alcohol, modified products thereof, SBR latex, NBR latex, carboxymethyl cellulose, hydroxymethyl cellulose, and polyvinyl pyrrolidone.

9. The ink jet recording medium according to claim 1, wherein said Mg ions are obtained from $MgCl_2$, and said SCN ions are obtained from NaSCN.

10. The ink jet recording medium according to claim 1, wherein said Mg ions are obtained from $MgCl_2$, and said SCN ions are obtained from $Ca(SCN)_2$.

* * * * *